United States Patent [19]

Hancock

[11] 4,043,050

[45] Aug. 23, 1977

[54] DRYING PLASTICS

[75] Inventor: Frank John Thompson Hancock, Wilmslow, England

[73] Assignee: Imperial Chemical Industries Limited, London, England

[21] Appl. No.: 714,808

[22] Filed: Aug. 16, 1976

Related U.S. Application Data

[62] Division of Ser. No. 484,936, July 1, 1974, Pat. No. 3,986,269.

[30] Foreign Application Priority Data

July 4, 1973 United Kingdom ..... 31768/73

[51] Int. Cl.[2] ..... F26B 19/00; F26B 3/34

[52] U.S. Cl. ..... 34/48; 34/1; 34/57 R; 34/168

[58] Field of Search ..... 34/1, 48, 34/57R, 168; 219/501; 318/610

[56] References Cited

U.S. PATENT DOCUMENTS

| | | | |
|---|---|---|---|
| 785,119 | 3/1905 | Provost | 34/168 |
| 2,497,501 | 2/1950 | Himmel et al. | 31/1 X |
| 2,641,848 | 6/1953 | Wilson | 34/168 |
| 2,748,330 | 5/1956 | Bergen | 318/610 |
| 2,830,245 | 4/1958 | Davis et al. | 318/610 |
| 3,093,460 | 6/1963 | Dietert | 31/1 |
| 3,111,398 | 11/1963 | Jones | 34/48 |
| 3,186,102 | 6/1965 | Brociner et al. | 34/48 |
| 3,378,245 | 4/1968 | Frank | 34/48 |
| 3,585,481 | 6/1971 | Steghart | 318/610 |
| 3,722,462 | 3/1973 | Pohler et al. | 219/501 |

*Primary Examiner*—John J. Camby
*Attorney, Agent, or Firm*—Cushman, Darby and Cushman

[57] ABSTRACT

Particles, e.g. granules, of plastic materials are dried by blowing air heated to 0.5–5° C below the sticking temperature of the granules through a bed of the particles. The air temperature is controlled by means of a proportional controller having integral and derivative terms.

8 Claims, 1 Drawing Figure

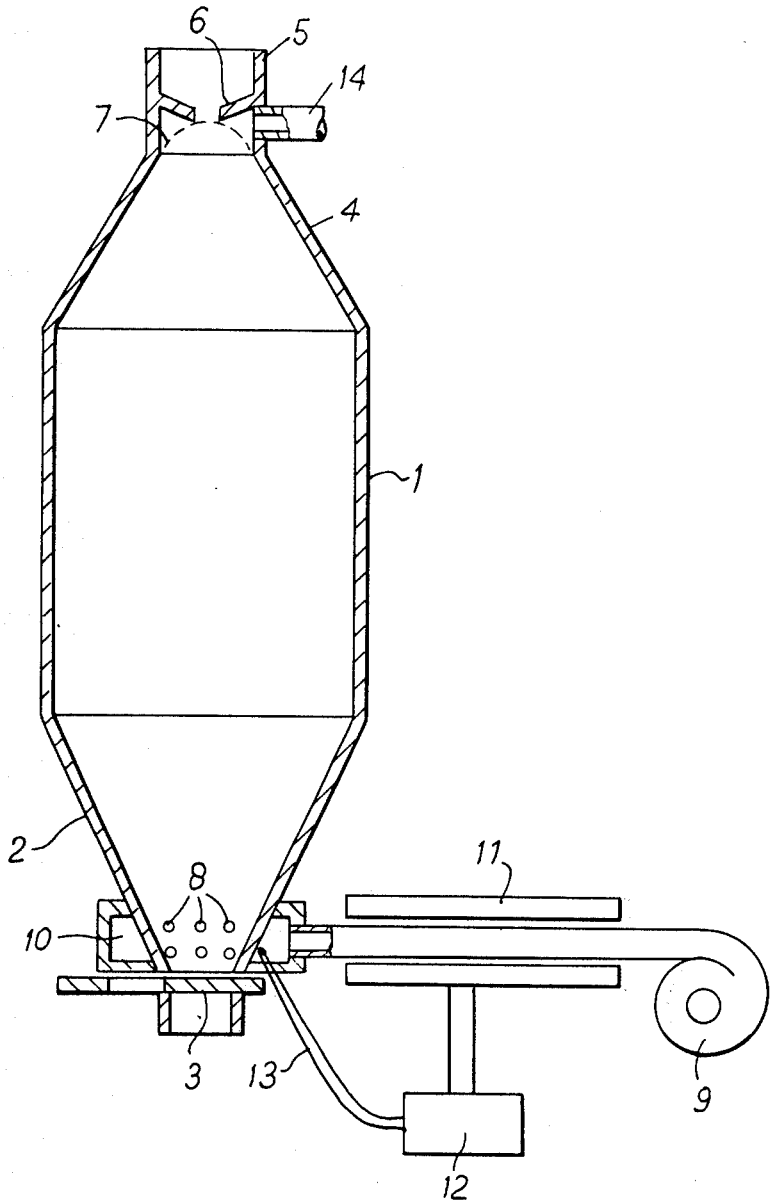
6
5
14
7
4
1
2
8
11
10
3
13
9
12

DRYING PLASTICS

This is a division of application Ser. No. 484,936 filed July 1, 1974, now U.S. Pat. No. 3,986,269.

This invention relates to drying plastics and in particular to drying thermoplastic polymeric materials in particulate, particularly granular, form.

Many plastic materials, such as ABS resins and polycarbonates are relatively hygroscopic and absorb appreciable quantities of water from the atmosphere. Prior to melt fabrication it is often necessary to dry the plastic as the presence of absorbed water gives rise to defects, e.g. blemishes, in the fabricated article. This is particularly the case in injection moulding fabrication techniques. For example ABS resins often contain about 0.3 - 0.4% by weight of absorbed water and, to avoid defects in an injection moulded article, it is desirable that the moisture level is reduced to below 0.15% by weight, and, preferably, to below 0.10% by weight.

Such plastic materials are conventionally dried by blowing a stream of heated air through a bed of the particulate polymer. The minimum time required to effect drying is determined by the rate of diffusion of the water out of the granules to the surface thereof. To minimise drying times it is desirable to heat the air, and hence the polymer particles, to as high a temperature as possible. However if heated to a too high temperature, the polymer particles begin to soften and stick together. The temperature at which sticking occurs can be established by heating some of the polymer particles in a sample tube in an accurately controlled oven and, after allowing the particles to achieve the oven temperature, tipping the particles out of the tube and observing whether any of the particles have stuck together. This is repeated at gradually increasing oven temperatures until the temperature at which sticking first occurs is found. For example most ABS resins have sticking temperatures within the range 90° - 95° C, the precise temperature depending on the particular grade of ABS resin utilised.

Therefore to avoid any risk of sticking the temperature of the air used must be below the sticking temperature. The air is generally heated to the drying temperature electrically and the electrical heaters are switched by means of temperature controllers. Most forms of temperature controller are liable to give considerable fluctuations in the air temperature and this means that, to avoid the risk of sticking of the particles, the air temperature is controlled at 10° C or more below the sticking temperature.

At such lower air temperatures drying times are often undesirably lengthy and so large batches have to be used to achieve a desired drying rate. This inevitably requires the use of bulky equipment or a multiplicity of smaller units.

Furthermore the use of such lower air temperatures may necessitate the use of dehumidifying equipment at certain times of the year in order to achieve dry enough polymer particles.

We have found that these disadvantages may be overcome by using higher air temperatures which are more accurately controlled.

Accordingly we provide a process for drying a particulate thermoplastic polymeric material by passing a stream of electrically heated air, the temperature of which is controlled at a temperature from 0.5° to 5° C below the sticking temperature of polymer particles by means of a proportional temperature controller having an integral term and a derivative term, through a bed of the polymer particles.

Such controllers, which are known as PID controllers, firstly exert proportionate control. Thus instead of exhibiting merely an on/off switching as the temperature fluctuates through the set temperatures they cut the power supplied to the heating elements when the air temperature enters a temperature band, known as the proportional band, which is generally adjustable in size and normally has a band width of about 5% of the full scale temperature. At the lower end of the band, which extends above and below the set temperature, all the available power is supplied to the heaters, while at the upper end of the band no power is supplied.

A controller with only a proportional band control will however only control the temperature at the set point in the rare circumstances that precisely half of the maximum heater power available is required to keep the temperature at the set point.

Furthermore the amount termed "amount of overshoot" by which the temperature that is maintained by a controller with just proportional control varies from the set temperature depends on a variety of factors including — the electrical supply voltage to the heaters; heat losses, e.g. to the atmosphere, the power consumption of the heaters. This amount of overshoot will thus vary if, inter alia, the air flow rate, supply voltage, and/or ambient temperature fluctuates. Hence it is not possible to control the temperature accurately by adjusting the set point to allow for a constant amount of overshoot.

To overcome these problems, the controller also has an integral term in addition to the proportional control. This feature of the controller moves the position of the proportional control band in dependence on the amount by which the temperature varies from the set temperature. Thus if the temperature of the air is lower than the set temperature, the proportional band is moved towards higher temperatures so that the power reduction commences at higher temperatures.

If however there is a rapid change in conditions, e.g. a temporary blockage causing a restriction in the air flow rate a rapid change in temperature is liable to occur. To accommodate such rapid changes the controller also has a derivative term. This feature moves the proportional band in dependence on the rate of temperature change.

Controllers incorporating these three terms (proportional, integral, and derivative) are capable of controlling the air temperature very accurately with little fluctuation. Generally the temperature can be maintained at within ±0.5° C of the set temperature.

We prefer to control the air temperature 1° - 4° C below the sticking temperature of the polymer particles.

The rate of the air flow that should be used is best determined by simple experimentation. If too low a rate is used then the drying will take longer than is necessary while the use of too high a rate is uneconomic. We prefer further that the air flow rate is insufficient to fluidise the polymer particles: thus the air preferably merely diffuses through the polymer particle bed. We have found that the most even air flow is achieved using a bed of polymer particles in a vertical cylindrical hopper surmounting an outlet cone. The air is preferably blown into the hopper through perforations in the lower part of the wall of the outlet cone. We have now found that if the bed has a height to maximum diameter ratio of at least 2.5:1, and preferably at least 2.7:1, there is no necessity for the use of an air diffuser in the hopper.

The hopper is preferably designed so that the air flow through the bed is distributed evenly. To this end, the hopper preferably comprises a vertical cylinder with a conical outlet at the base and a reverse cone at the top surmounted by an inlet. The angle of the latter cone to the horizontal is preferably greater than the angle of repose of the granules (an angle of about 55° - 65° is convenient) so that, when the bed is operated with the granule bed up to the level of the inlet of the reverse cone, the granules lie against the surface of the reverse cone. This assists even air flow throughout the hopper and avoids the tendency for the air merely to flow up the hopper walls. A suitable feed arrangement is preferably provided to maintain the bed level up to the inlet of the reverse cone.

The release of dried material from the hopper may be controlled by a suitable valve, e.g. a slide valve at the base of the outlet cone.

By virtue of the invention, hoppers may be used that are considerably smaller than those utilised heretofor for the same throughput. Hence capital costs can be reduced and space, which is often at a premium, can be saved. This is particularly true when the drier is to be mounted directly above the feed of an injection moulding machine.

We further provide apparatus comprising a. a hopper having (i) a vertical cylindrical portion, and connected therebeneath, (ii) a conical base portion provided with (iii) an outlet orifice, said conical base portion being provided with a plurality of perforations adjacent the outlet orifice,
b. means to supply air to said perforations,
c. electric heaters arranged to heat the air supplied to said perforations,
d. a proportional temperature controller having an integral term and a derivative term,
e. a thermocouple positioned to respond to the temperature of the air after passage past the heaters and connected to actuate the controller which is arranged to control the electrical heaters.

The air temperature measurement used to control the PID controller is preferably obtained from a thermocouple mounted adjacent to the preforations in the cone wall.

The air is preferably supplied from a throttled high pressure blower so that differences in air throughput due to differences in back pressure exerted by the bed are kept to a minimum.

A typical arrangement is illustrated in the accompanying drawing which shows a diagrammatic section through the hopper together with the associated equipment.

The hopper consists of a vertical cylinder 1 provided with a conical base 2 terminating in an outlet provided with a slide valve 3. The included apex angle of the conical base is 50°. The top of the cylinder 1 is provided with a reverse cone 4 having an included apex angle of 60°. At the apex thereof an inlet 5 provided with a granule feed 6 arranged so that the bed of granules lies up to the dotted line 7. The height of the bed, i.e. from slide valve 3 to the bottom of inlet 5 is 76 cm while the inside diameter of cylinder 1 is 28 cm. The ratio of the bed height to maximum diameter is thus about 2.7:1.

At the lower end of the conical base 2 a series of perforations 8 are provided and these are supplied with air from a throttled high pressure blower 9 via a plenum chamber 10.

Electrical heaters 11 are provided to heat the air from blower 9 and these heaters are controlled by a PID controller 12. The air temperature signal to actuate the controller is measured by means of a thermocouple 13 positioned adjacent one of the perforations 8. The air, after passing through the bed, is exhausted to the atmosphere through vent 14.

The invention is illustrated by the following examples.

EXAMPLE 1

The apparatus described above was filled with ABS resin granules containing 0.35% by weight of water and having a sticking temperature of 92° C. Air, at a temperature of 90° ± 0.25° C, was blown through the bed. The air had a dew point of 21° C which is about the maximum liable to be encountered in the United Kingdom.

The time taken to achieve a moisture content of 0.1% by weight was 17 minutes.

By way of comparison using a set air temperature of 85° ± 0.25° C the time taken was 25 minutes while at 80° ± 0.25° C the time taken was about 32 minutes.

EXAMPLE 2

The apparatus described above, which had a capacity of 18 kg of granules, was used to dry granules of an ABS resin of sticking temperature 95° C at a throughput rate of 25 kg/hr. The initial water content was 0.2% by weight. The air flow rate was 12.3 liters/sec, and the air temperature was 94° ± 0.5° C. The water content of the dried granules was 0.05% by weight.

EXAMPLE 3

The apparatus described above was used to dry granules of a polycarbonate resin of sticking temperature 121° C at a throughput rate of 25 kg/hr. The initial water content was 0.106% by weight. The granules were dried using an air flow rate of 10.9 liters/sec, with the air temperature 120° ± 0.5° C.

The final water content was 0.022% by weight. To achieve this final water content at a throughput of 25 kg/hr using a conventional drying system, a hopper of capacity about 75 kg would be needed.

Similar results could be obtained for polystyrene, polyethylene terephthalate and nylons, such as glass fibre filled nylon 66.

I claim:

1. Apparatus comprising a. a hopper having (i) a vertical cylindrical portion, and connected therebeneath, (ii) a conical base portion provided with (iii) an outlet orifice, said conical base portion being provided with a plurality of perforations adjacent the outlet orifice,
b. means to supply air to said perforations,
c. electric heaters arranged to heat the air supplied to said perforations,
d. a proportional temperature controller having an integral term and a derivative term,
e. a thermocouple positioned to respond to the temperature of the air after passage past the heaters and connected to actuate the controller which is arranged to control the electrical heaters.

2. Apparatus as claimed in claim 1 wherein the thermocouple is mounted adjacent one of the perforations.

3. Apparatus as claimed in claim 1 wherein the air is supplied by a throttled high pressure blower.

4. Apparatus as claimed in claim 1 wherein the hopper is provided with a reverse conical portion above the vertical cylindrical portion.

5. Apparatus as claimed in claim 4 wherein the angle of the reverse conical portion to the horizontal is between 55° and 65°.

6. Apparatus as claimed in claim 1 wherein feed means are provided to maintain the level of particulate material at a predetermined level in the hopper.

7. Apparatus as claimed in claim 4 wherein the length of the hopper from the outlet orifice to the top of the reverse conical portion is at least 2.5 times the maximum internal diameter of the hopper.

8. Apparatus as claimed in claim 6 wherein the length of the hopper from the outlet to the predetermined level is at least 2.5 times the maximum internal diameter of the hopper.

* * * * *